US010624166B1

(12) United States Patent
Shao

(10) Patent No.: US 10,624,166 B1
(45) Date of Patent: Apr. 14, 2020

(54) PARALLEL CIRCUIT FOR LIGHT EMITTING DIODE

(71) Applicant: BLOOMING INTERNATIONAL LIMITED, British West Indies (AI)

(72) Inventor: Shu-Fa Shao, Taipei (TW)

(73) Assignee: Blooming International Limited, British West Indies (AI)

( * ) Notice: Subject to any disclaimer, the term of this patent is extended or adjusted under 35 U.S.C. 154(b) by 0 days.

(21) Appl. No.: 16/185,467

(22) Filed: Nov. 9, 2018

(30) Foreign Application Priority Data

Sep. 21, 2018 (CN) ..... 2018 1 1106120

(51) Int. Cl.

| | |
|---|---|
| ***H05B 33/08*** | (2020.01) |
| ***F21V 23/00*** | (2015.01) |
| ***F21S 4/10*** | (2016.01) |
| *F21Y 115/10* | (2016.01) |

(52) U.S. Cl.
CPC ..... *H05B 33/0827* (2013.01); *F21S 4/10* (2016.01); *F21V 23/001* (2013.01); *H05B 33/0845* (2013.01); *F21Y 2115/10* (2016.08)

(58) Field of Classification Search
CPC ..... H05B 33/0803; H05B 33/0809; H05B 33/0821; H05B 33/0845; H05B 33/0827; F21V 33/0028; F21V 23/001; F21V 23/02; F21S 4/10; F21S 4/26; F21S 10/00;
(Continued)

(56) References Cited

U.S. PATENT DOCUMENTS

| | | | |
|---|---|---|---|
| 2,201,045 | A | 5/1940 | Lundstrom |
| 2,857,506 | A | 10/1958 | Minteer |
| 3,603,780 | A | 9/1971 | Lu |

(Continued)

FOREIGN PATENT DOCUMENTS

| | | | |
|---|---|---|---|
| CA | 2 655 486 | A1 | 9/2009 |
| CN | 200982547 | Y | 11/2007 |

(Continued)

OTHER PUBLICATIONS

Advancement International, Standard Wire and Solid Wire, https://mechanicallugs.com/index.php.standed-vs-solid; Jan. 19, 2016.

(Continued)

*Primary Examiner* — Haissa Philogene
(74) *Attorney, Agent, or Firm* — Christensen, Fonder, Dardi & Herbert PLLC

(57) ABSTRACT

A parallel circuit for light emitting diodes includes a first power wire, a second power wire, a first light emitting diode, a second light emitting diode, and a second impedance element. The first LED includes a first turn-on voltage, and two ends of the first LED are respectively connected to the first power wire and the second power wire. The second LED includes a second turn-on voltage, and the first turn-on voltage is different from the second turn-on voltage. The second impedance element and the second LED are connected to form a second series circuit. One end of the second series circuit is electrically connected to the first power wire, while the other end of the second series circuit is electrically connected to the second power wire. In the parallel circuit, different LEDs are respectively driven by different voltages to emit light with pre-determined brightness.

18 Claims, 4 Drawing Sheets

(58) Field of Classification Search
CPC ..... F21W 2121/00; F21W 2121/04; Y10S 362/80; Y10S 362/806
See application file for complete search history.

(56) References Cited

U.S. PATENT DOCUMENTS 3,617,732 A 11/1971 Fisher
3,970,834 A 7/1976 Smith
3,985,924 A 10/1976 Pritza
4,020,201 A 4/1977 Miller
4,140,823 A 2/1979 Weskamp
4,161,768 A 7/1979 Caverzan
4,675,575 A * 6/1987 Smith ..... F21S 4/10 250/552
4,761,720 A 8/1988 Solow
4,812,956 A 3/1989 Chen
4,870,547 A 9/1989 Crucefix
4,908,743 A 3/1990 Miller
5,015,510 A 5/1991 Smith
5,091,834 A 2/1992 Kao et al.
5,150,964 A 9/1992 Tsui
5,245,519 A 9/1993 Openiano
5,311,417 A 5/1994 Heh
5,609,412 A 3/1997 Contigiani
5,700,081 A 12/1997 Mengle et al.
5,747,940 A 5/1998 Openiano
5,776,559 A 7/1998 Woolford
5,834,901 A 11/1998 Shen
5,839,819 A 11/1998 Pan
5,855,705 A 1/1999 Gauthier
5,860,731 A 1/1999 Martinez
5,884,125 A 3/1999 Taniguchi
5,975,717 A 11/1999 Rahman
6,042,418 A 3/2000 Cummings
6,086,221 A 7/2000 Wu
6,086,222 A 7/2000 Juba
6,152,576 A 11/2000 Mount
6,273,584 B1 8/2001 Wang
6,309,087 B1 10/2001 Huang et al.
6,347,965 B1 2/2002 Pan
6,354,719 B1 3/2002 Pan
6,367,952 B1 4/2002 Giboney, Jr.
6,582,094 B2 6/2003 Liu
6,592,238 B2 7/2003 Cleaver et al.
6,604,841 B2 8/2003 Liu
6,652,927 B1 11/2003 Chen
6,758,001 B1 7/2004 Su
6,769,954 B2 8/2004 Su
6,777,891 B2 8/2004 Lys et al.
6,883,951 B2 4/2005 Wu
6,908,215 B2 6/2005 Wu
6,914,194 B2 7/2005 Fan
6,974,227 B2 12/2005 Tsai
7,052,156 B2 5/2006 Primeau
7,062,442 B2 6/2006 Sugar
7,088,904 B2 8/2006 Ryan, Jr.
7,131,748 B2 11/2006 Kazar et al.
7,152,998 B2 12/2006 Rahman
7,160,140 B1 1/2007 Mrakovich et al.
7,186,005 B2 3/2007 Hulse
7,250,730 B1 * 7/2007 Allen ..... H05B 33/0803 315/185 R
7,253,566 B2 8/2007 Lys et al.
7,445,824 B2 11/2008 Leung et al.
7,481,555 B2 1/2009 Huang et al.
7,494,244 B1 2/2009 Van Diep
7,554,266 B1 6/2009 Chen
7,569,996 B2 * 8/2009 Holmes ..... H05B 33/0815 315/291
7,661,847 B2 2/2010 Wang
7,726,829 B2 * 6/2010 Stuhr ..... A01K 63/006 362/101
7,784,961 B1 8/2010 Rawlings
D623,084 S 9/2010 Chen et al.
7,926,978 B2 4/2011 Tsai
7,976,191 B2 7/2011 Gibboney
8,016,440 B2 * 9/2011 Yu ..... F21K 9/00 362/18
8,203,275 B2 6/2012 Ruxton
8,309,188 B2 11/2012 Cheng
8,397,381 B2 3/2013 Tsai
8,454,186 B2 6/2013 Chen
8,454,187 B2 6/2013 Chen
8,469,734 B2 6/2013 Chen
8,469,750 B2 6/2013 Chen
8,480,278 B2 7/2013 Wasem
8,562,175 B2 10/2013 Chen
8,568,015 B2 10/2013 Chen
8,569,960 B2 10/2013 Chen
8,592,845 B2 11/2013 Chen
8,598,805 B2 12/2013 Tremblay
8,608,342 B2 12/2013 Chen
8,622,576 B2 1/2014 Zhan
8,641,229 B2 2/2014 Li
8,678,615 B1 3/2014 Ko
8,680,773 B2 3/2014 Hering et al.
8,870,404 B1 10/2014 Chen
8,876,321 B2 11/2014 Chen
8,974,072 B2 3/2015 Chen
9,044,056 B2 6/2015 Chen
9,055,777 B2 6/2015 Chen
9,066,617 B2 6/2015 Chen
9,119,495 B2 9/2015 Leung et al.
9,140,438 B2 9/2015 Chen
9,157,587 B2 10/2015 Chen
9,179,793 B2 11/2015 Chen
9,220,361 B1 12/2015 Chen
9,222,656 B2 12/2015 Chen
9,243,788 B2 1/2016 Chen
9,279,551 B2 3/2016 Vissenberg et al.
9,291,318 B1 3/2016 Benson
9,386,652 B1 7/2016 Lee
9,439,528 B2 9/2016 Chen
9,441,800 B1 9/2016 Chen
9,441,823 B1 9/2016 Chen
9,468,062 B2 * 10/2016 Rybicki ..... H05B 33/0845
9,526,286 B2 12/2016 Chen
9,572,446 B2 2/2017 Chen
9,593,831 B2 * 3/2017 Yu ..... F21V 23/06
9,655,211 B2 5/2017 Altamura et al.
9,671,097 B2 6/2017 Chen
9,675,575 B2 6/2017 Sandnes et al.
9,677,748 B1 6/2017 Chen
9,677,749 B2 6/2017 Chen
9,752,771 B2 9/2017 Loos
9,763,298 B2 * 9/2017 Weeks, Jr. ..... H05B 33/0827
9,788,384 B1 10/2017 Harris
9,845,925 B2 12/2017 Chen
9,883,556 B2 1/2018 Chen
9,907,136 B2 2/2018 Leung et al.
9,939,117 B1 4/2018 Peng
10,006,596 B2 6/2018 Yu et al.
10,123,387 B2 11/2018 Lai
10,136,497 B2 11/2018 Harris
10,184,654 B1 1/2019 Chen
10,288,235 B1 5/2019 Chen
10,288,236 B1 * 5/2019 Chen ..... F21S 4/26
2002/0027778 A1 3/2002 Ko
2002/0097573 A1 7/2002 Shen
2003/0063463 A1 4/2003 Sloan et al.
2004/0012950 A1 1/2004 Pan
2004/0080281 A1 4/2004 Pan
2004/0090770 A1 5/2004 Primeau
2004/0096596 A1 5/2004 Palmer, III et al.
2004/0246718 A1 12/2004 Fan
2005/0047136 A1 3/2005 Fan
2005/0174065 A1 8/2005 Janning
2005/0249892 A1 11/2005 Rocheleau
2006/0158878 A1 7/2006 Howell
2006/0221609 A1 10/2006 Ryan, Jr.
2007/0015396 A1 1/2007 Mrakovich et al.
2007/0177402 A1 8/2007 Wu
2007/0230174 A1 10/2007 Hicks
2007/0262725 A1 11/2007 Koren

(56) References Cited

U.S. PATENT DOCUMENTS

| | | | |
|---|---|---|---|
| 2008/0049424 | A1 | 2/2008 | Wang |
| 2008/0084695 | A1 | 4/2008 | Hsu |
| 2008/0084702 | A1 | 4/2008 | Cheung |
| 2008/0094828 | A1 | 4/2008 | Shao |
| 2008/0218092 | A1 | 9/2008 | Chang et al. |
| 2009/0302771 | A1 | 12/2009 | Peng |
| 2010/0001664 | A1 | 1/2010 | Shih |
| 2010/0072747 | A1 | 3/2010 | Krize |
| 2010/0141161 | A1 | 6/2010 | Hering et al. |
| 2010/0277084 | A1 | 11/2010 | Lee |
| 2011/0062875 | A1 | 3/2011 | Altamura |
| 2011/0074300 | A1 | 3/2011 | Hsu |
| 2011/0148311 | A1 | 6/2011 | Neuman |
| 2011/0210677 | A1 | 9/2011 | Hering et al. |
| 2011/0228535 | A1 | 9/2011 | Shao |
| 2012/0007510 | A1 | 1/2012 | Horng |
| 2012/0075863 | A1 | 3/2012 | Chen |
| 2012/0275157 | A1 | 11/2012 | Hsu |
| 2013/0078847 | A1 | 3/2013 | Chen |
| 2013/0107514 | A1 | 5/2013 | McNabb et al. |
| 2013/0140993 | A1 | 6/2013 | Buerrig |
| 2013/0181232 | A1 | 7/2013 | Jeromerajan |
| 2013/0249417 | A1 | 9/2013 | Verlinden |
| 2013/0301246 | A1 | 11/2013 | Chen |
| 2014/0055439 | A1 | 2/2014 | Lee |
| 2014/0268869 | A1 | 9/2014 | Chen |
| 2014/0334134 | A1 | 11/2014 | Loomis |
| 2015/0008835 | A1 | 1/2015 | Sugiura et al. |
| 2015/0029703 | A1 | 1/2015 | Chen |
| 2015/0070878 | A1 | 3/2015 | Yu |
| 2015/0078000 | A1 | 3/2015 | Chen |
| 2015/0157159 | A1 | 6/2015 | Leung et al. |
| 2016/0123566 | A1 | 5/2016 | Leung |
| 2016/0183338 | A1 | 6/2016 | Loomis |
| 2016/0338171 | A1 | 11/2016 | Bhagat |
| 2016/0341408 | A1 | 11/2016 | Altamura |
| 2017/0038055 | A1 | 2/2017 | Daniels |
| 2017/0114967 | A1 | 4/2017 | Chen |
| 2017/0295622 | A1 | 10/2017 | Harris |
| 2017/0328527 | A1 | 11/2017 | Yang et al. |
| 2017/0343170 | A1 | 11/2017 | Yu et al. |
| 2018/0020519 | A1 | 1/2018 | Harris |
| 2018/0020520 | A1 | 1/2018 | Harris |
| 2018/0084695 | P1 | 3/2018 | Lee |
| 2018/0110101 | A1 | 4/2018 | Kottritsch |
| 2018/0172225 | A1 | 6/2018 | Zhao |
| 2018/0172226 | A1 | 6/2018 | Zhao |
| 2018/0231226 | A1 | 8/2018 | Koo |
| 2018/0299084 | A1 | 10/2018 | Chien |
| 2019/0053348 | A1 | 2/2019 | Harris |
| 2019/0078767 | A1 | 3/2019 | Loomis |
| 2019/0277458 | A1 | 9/2019 | Shao |

FOREIGN PATENT DOCUMENTS

| | | | |
|---|---|---|---|
| CN | 201121811 | Y | 9/2008 |
| CN | 201897194 | U | 7/2011 |
| CN | 201898147 | U | 7/2011 |
| CN | 201966240 | U | 9/2011 |
| CN | 202613183 | U | 12/2012 |
| CN | 203703878 | U | 7/2014 |
| DE | 8436328 | | 4/1985 |
| EP | 1 172 602 | A1 | 1/2002 |
| GB | 2 454 546 | A | 5/2009 |

OTHER PUBLICATIONS

American Wire Gauge Sizes and Properties Chart; https://www.solaris-shop-com/content/American%20Wire%20Gauge%20Conductor%20Size%20Table.pdf (2009).

* cited by examiner

PARALLEL CIRCUIT FOR LIGHT EMITTING DIODE

RELATED APPLICATIONS

The present application claims priority to Chinese Patent Application No. 201811106120.4, filed on Sep. 21, 2018, which said application is incorporated by reference in its entirety herein

FIELD OF THE INVENTION

The present invention relates to a light string, and in particular to a parallel circuit for light emitting diodes.

BACKGROUND

A light string includes a plurality of light sources directly soldered onto an electric cord at intervals, so as to form a string-shaped illumination device without a lamp holder in the art. To small-sized light sources, such as small bulbs, light emitting diodes (LEDs), light strings are a common arrangement of the light sources. A light string is as flexible as the electric cord is, such that the light string is easily arranged in any configuration to comply with requirements for special illumination or decoration.

A known simple light string is that is connected to a plurality of light sources in parallel among two power wires. In this parallel circuit, the driving voltage difference is required to drive individual light sources, which is different than in a series circuit, as the driving voltage has to be raised when the number of the light sources is increased. Meanwhile, in the parallel circuit, individual failed light source will not cut off the power loop of the other light sources.

However, when various types of LEDs are simultaneously used as the light sources, various turn-on voltages exist. When LEDs of various colors, or shades of colors, are simultaneously used, ratios of brightness of these colors have to be proper determined to achieve preferable visual effects. However in a parallel circuit, an LED with a low turn-on voltage could lower down the driving voltage difference among two power wires, such that the voltage difference between two ends of a high turn-on voltage LED is too low and any high turn-on voltage LEDs will not be turned-on or will emit light with insufficient brightness. If the driving voltage difference is raised to drive the high turn-on voltage LEDs, the brightness of the low turn-on voltage LEDs could be too high, thereby causing the low turn-on voltage LEDs to fail. Therefore, when LEDs of various colors are simultaneously used, a plurality of circuits are required to drive LEDs with different colors.

SUMMARY

This disclosure provides a parallel circuit for light emitting diodes to solve the above-identified problem.

In an embodiment, the present disclosure provides a parallel circuit for light emitting diodes, including a first power wire, a second power wire, a first light emitting diode (first LED), a second light emitting diode (second LED), and a second impedance element. The first LED includes a first turn-on voltage, and two ends of the first LED are respectively connected to the first power wire and the second power wire. The turn-on voltage will be understood to be the voltage difference between the anode and the cathode of the LED causing the LED to emit light. The second LED includes a second turn-on voltage, wherein the first turn-on voltage is different from the second turn-on voltage. The second impedance element and the second LED are connected into a second series circuit. wherein one end of the second series circuit is electrically connected to the first power wire, while the other end of the second series circuit is electrically connected to the second power wire.

In one or more embodiments, the second turn-on voltage is smaller than the first turn-on voltage.

In one or more embodiments, the first power wire and the second power wire provide a driving voltage difference, and the driving voltage difference is larger than the first turn-on voltage.

In one or more embodiments, the second impedance element adjusts, or determines by its characteristics, the voltage difference between the two ends of the second light emitting diode, such that the voltage difference of the two ends of the second light emitting diode is smaller than the driving voltage difference and larger than the second turn-on voltage.

In one or more embodiments, the second impedance element is a resistor or a diode.

In one or more embodiments, the parallel circuit for light emitting diode further includes a first impedance element, and the first impedance element is connected to the first light emitting diode to form a first series circuit; wherein one end of the first series circuit is electrically connected to the first power wire while the other end of the first series circuit is electrically connected to the second power wire.

In one or more embodiments, the first impedance element adjusts the voltage difference of the two ends of the first light emitting diode (across the first LED), such that the voltage difference of the two ends of the first light emitting diode is smaller than the driving voltage difference and larger than the first turn-on voltage.

In one or more embodiments of the present invention, LEDs with various turn-on voltages can be arranged in parallel, and each of the LEDs can emit light with a pre-determined brightness, so as to prevent the problem that the low turn-on voltage LED makes the other LEDs unable to be turned-on or to be turned-on with a lower brightness.

Embodiments also include an artificial tree, net-style decorative lighting structure, and icicle-style decorative lighting structure that utilize multiple light strings of the present invention to provide a tree, etc., with uniform color and brightness.

BRIEF DESCRIPTION OF THE DRAWINGS

The present invention will become more fully understood from the detailed description given herein below for illustration only, and thus not limitative of the present invention, wherein.

DETAILED DESCRIPTION

Figure 1:
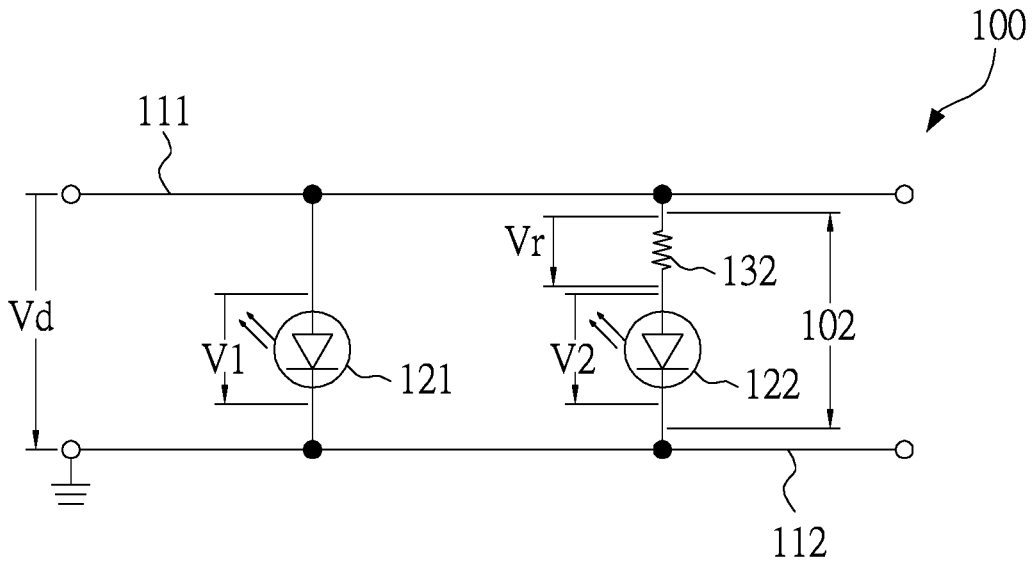
FIG. 1 is a circuit diagram of the parallel circuit for light emitting diodes according to a first embodiment of the present invention.

Referring to FIG. 1, a parallel circuit 100 for light emitting diodes (LEDs) according to a first embodiment includes a first power wire 111, a second power wire 112, a first LED 121, a second LED 122, and a second impedance element 132.

As shown in FIG. 1, the first power wire 111 and the second power wire 112 provide a driving voltage difference Vd. In an example, the first power wire receives a power input, and the second power wire 112 is electrically grounded, so as to form the driving voltage difference Vd between the first power wire 111 and the second power wire 112. First power wire 111 and second power wire 112 include a first conductor and a second conductor, respectively. In an embodiment, the first and second conductors are substantially enclosed in an insulating material to respectively form the first power wire 111 and the second power wire 112.

As shown in FIG. 1, the first LED 121 includes a first turn-on voltage V1, and the second LED 122 includes a second turn-on voltage V2. The first turn-on voltage V1 is different from the second turn-on voltage V2, and the second turn-on voltage V2 is smaller than the first turn-on voltage V1.

As shown in FIG. 1, the positive electrode (anode) at a first end of the first LED 121 is connected to the first power wire 111, while the negative electrode (cathode) of a second end of the first LED 121 is connected to the second power wire 112. That is two ends of the first LEDs 121 are respectively connected to the first power wire 111 and the second power wire 121, so as to drive the first LED 121 by the driving voltage difference Vd. When the driving voltage difference Vd matches the forward-bias of the first LEDs 121 and the driving voltage difference Vd is larger than the first turn-on voltage V1, the first LED 121 is driven to emit light.

As shown in FIG. 1, the second impedance element 132 and the second LED 122 are connected into a second series circuit 102. One end of the second series circuit 102 is electrically connected to the first power wire 111, while the other end of the second series circuit 102 is electrically connected to the second power wire 112. The second impedance element 132 adjusts the voltage difference of the two ends of the second light emitting diode 122, such that the voltage difference of the two ends of the second LED 122 is smaller than the driving voltage difference Vd.

As shown in FIG. 1, when the driving voltage difference Vd is larger than the first turn-on voltage V1, An impedance voltage difference Vr is generated on the second impedance element 132, such that the voltage difference of the two ends of the second LED 122 is adjusted to be slightly larger than the second turn-on voltage V2.

In an embodiment, circuit 100 is part of a light string having multiple lamps or light elements. In one such embodiment, LED 121 forms a lamp, and/or circuit 102 with second impedance device 132 and LED 122 form a lamp or light element. In an embodiment, LED 121 is covered in a transparent or translucent material, such as a transparent glue, so as to form a lamp on wires 111 and 112. LED 122 and second impedance device 132 may be commonly encompassed by a transparent or translucent material, such as a transparent glue to form another lamp on wires 111 and 112. In an embodiment, circuit 102 and LED 121 are commonly covered in a transparent material to form a single lamp.

In an embodiment, the light string includes multiple lamps and a power plug. In an embodiment, the light string may include an optional controller for selectively controlling LEDs 121 and 122.

Figure 2:
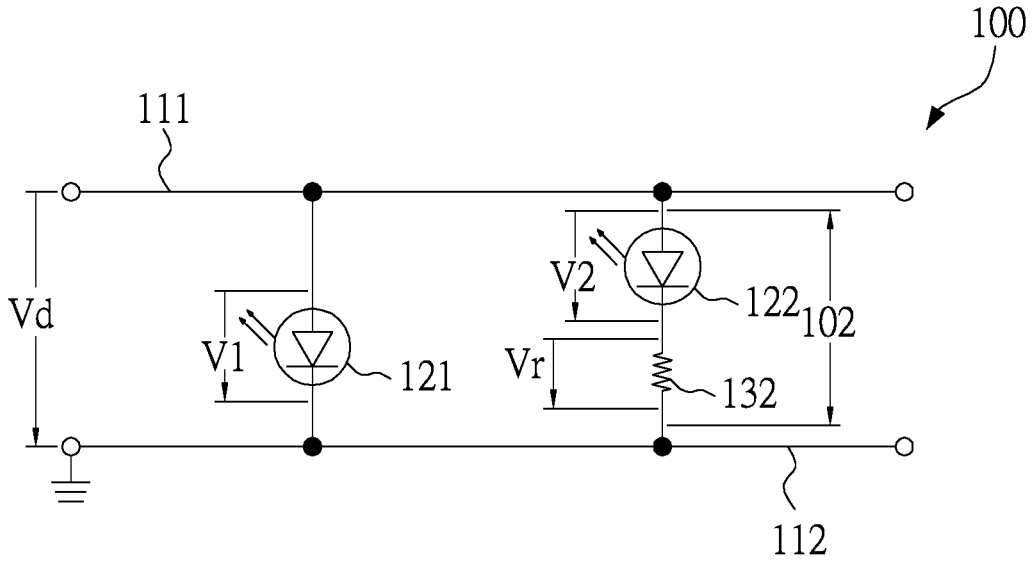
FIG. 2 is another circuit diagram of the parallel circuit for light emitting diodes according to a first embodiment of the present invention.

As shown in FIG. 2, in the first embodiment, the second impedance element 132 is a resistor, although the resistor in the drawing of FIG. 1 is connected to the first power wire 111, the resistor could be connected to the second power wire 112, as long as the second LED 112 and the second impedance element 132 are connected into a second series circuit 102 between the first power wire 111 and the second power wire 112, and the second series circuit 102 and the first LED 121 are connected in parallel.

In an example, the first LED 121 and the second LED 122 are made of different photoelectric materials, such that the first LED 121 and the second LED 122 have different turn-on voltages and emit lights of different colors. For example, a color of a first LED 121 may be red, and a color of a second LED 122 may be blue. The presence of the impedance voltage, causes an adjustment of the voltage difference across the second LED 122, such that the first LED 121 and the second LED 122 are driven by different forward-bias voltages, and such that the ratio of brightness of the first LED 121 and the second LED 122 can be adjusted accordingly. Such a configuration also prevents the first LED 121 having a high turn-on voltage from being interfered with by the second LED 122 having a low turn-on voltage.

In some embodiments, the difference in color may be a difference in a shade of a same color due to manufacturing variances, or due to selection of LEDs from different manufacturers, and so on. In one such embodiment, the first LED 121 is a dark blue color, while the second LED 122 is a light blue color.

Figure 3:
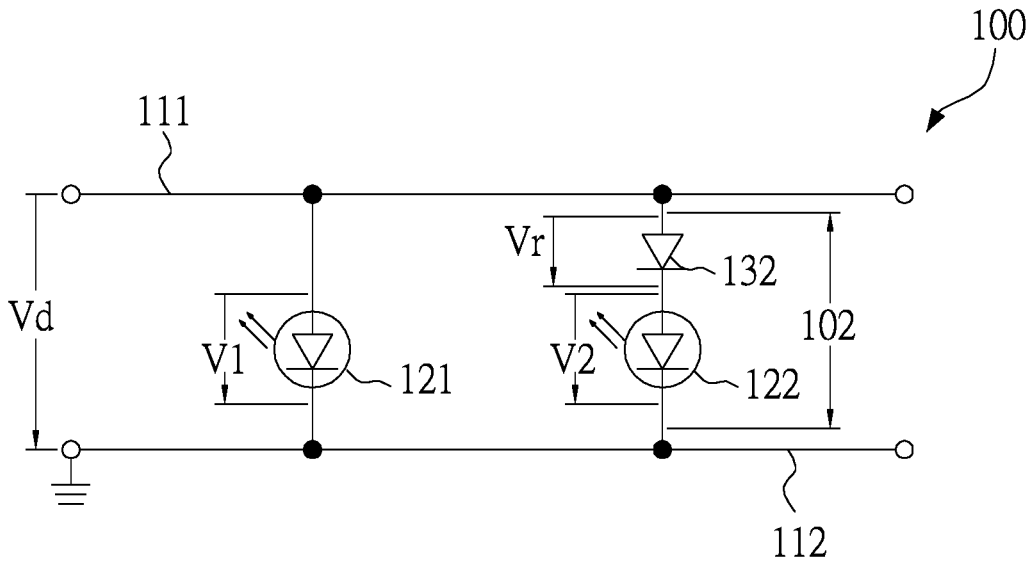
FIG. 3 is a circuit diagram of the parallel circuit for light emitting diodes according to a second embodiment of the present invention.

As shown in FIG. 3, a parallel circuit 100 for LEDs according to a second embodiment includes a first power wire 111, a second power wire 112, a first LED 121, a second LED 122, and a second impedance element 132.

Figure 4:
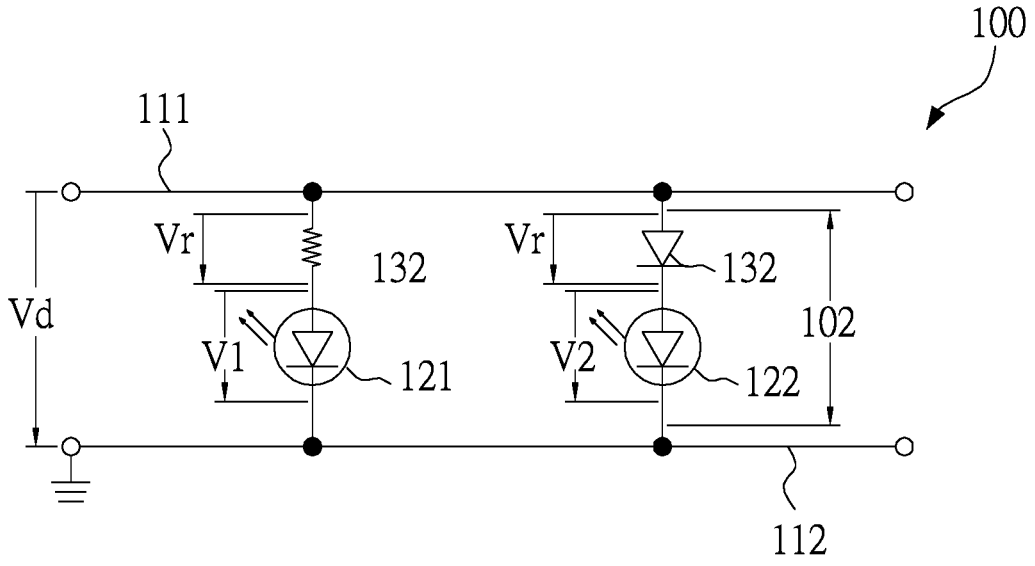
FIG. 4 is a circuit diagram of the parallel circuit for light emitting diodes according to a third embodiment of the present invention.

As shown in FIG. 3, the second embodiment is approximately the same as the first embodiment, the difference lies in that the second impedance element 132 in the second embodiment is a diode used to adjust the voltage difference between the two ends of the second LED 122 (between the anode and the cathode), therefore the first LED 121 and the second LED 122 are driven by different forward-bias voltages, the ratio of brightness of the first LED 121 and the second LED 122 can thereby be adjusted accordingly by choosing an "impedance" LED to have a desired voltage drop, and to prevent the first LED 121 having a relatively high turn-on voltage from being interfered with by the second LED 122 having a relatively low turn-on voltage. Referring to FIG. 4, a parallel circuit 100 for LEDs according to a third embodiment includes a first power wire 111, a second power wire 112, a first LED 121, a second LED 122, a first impedance element 131, and a second impedance element 132.

As shown in FIG. 4, the first impedance element 131 and the first LED 121 are connected into a first series circuit 101. One end of the first series circuit 101 is electrically connected to the first power wire 111, while the other end of the first series circuit 101 is electrically connected to the second power wire 112. The first impedance element 131 adjusts the voltage difference across the two ends of the first LED 121 (anode-to-cathode), such that the voltage difference of the two ends of the first LED 121 is smaller than the driving voltage difference Vd and larger than the first turn-on voltage V1.

As shown in FIG. 4, when the first power wire 111 and the second power wire 112 provide a driving voltage difference Vd, an impedance voltage difference Vr is generated on the first impedance element 131, such that the voltage difference of the two ends of the first LED 121 is smaller than the driving voltage difference Vd, and the voltage difference of the two ends of the first LED 121 is larger than the first turn-on voltage V1.

As shown in FIG. 4, the first impedance element 131 or the second impedance element 132 in the third embodiment is a resistor or a diode, although the resistor/diode in the FIG. 4 is connected to the first power wire 111, the resistor/diode could be connected to the second power wire 112, as long as the first LED 111 and the first impedance element 131 are connected into a second series circuit 102 between the first power wire 111 and the second power wire 112, the second impedance element 132 and the second LED 122 are connected into a second series circuit 102, and the first series circuit 101 and the second series circuit 102 are connected in parallel.

The first impedance element 131 and the second impedance element 132 are selected according to the turn-on voltages V1, V2 of the first LED 121 and the second LED 122, so as to adjust the ratio of brightness of the first LED 121 and the second LED 122.

Figure 5:
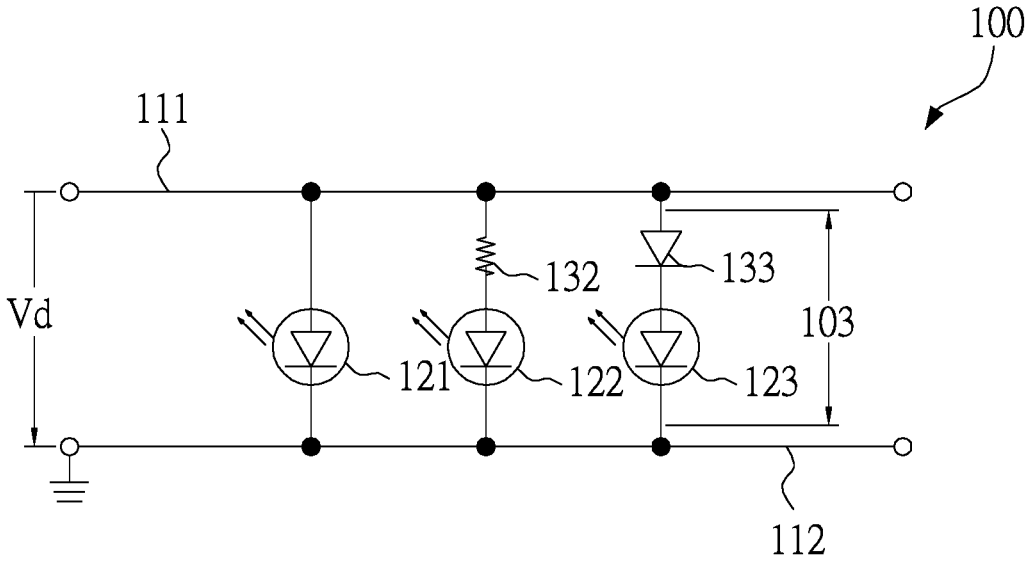
FIG. 5 is a circuit diagram of the parallel circuit for light emitting diodes according to a fourth embodiment of the present invention.

As shown in FIG. 5, a parallel circuit 100 for LEDs according to a fourth embodiment includes a first power wire 111, a second power wire 112, a first LED 121, a second LED 122, and a second impedance element 132.

As shown in FIG. 5, The parallel circuit 100 further includes a third LED 123 and a third impedance element 133 connected into a third series circuit 103. The third series circuit 103, the first series circuit 101 and the second series circuit 102 are connected in parallel. Therefore, in third series circuit 103, a voltage difference between two ends of the third impedance element 133 can be adjusted by adjusting the impedance value of the third impedance element 133.

As shown in FIG. 5, the third series circuit 103 can be identical to the second series circuit 102 or different from the second series circuit 102. The fourth embodiment is to illustrate that the parallel circuit 100 for LEDs can be equipped with a plurality of series circuits having different electrical characteristics and brightness requirements, and the number of the series circuits between the first power wire 111 and the second power wire 112 is not limited to two series circuits as shown in the other embodiments.

Figure 6:
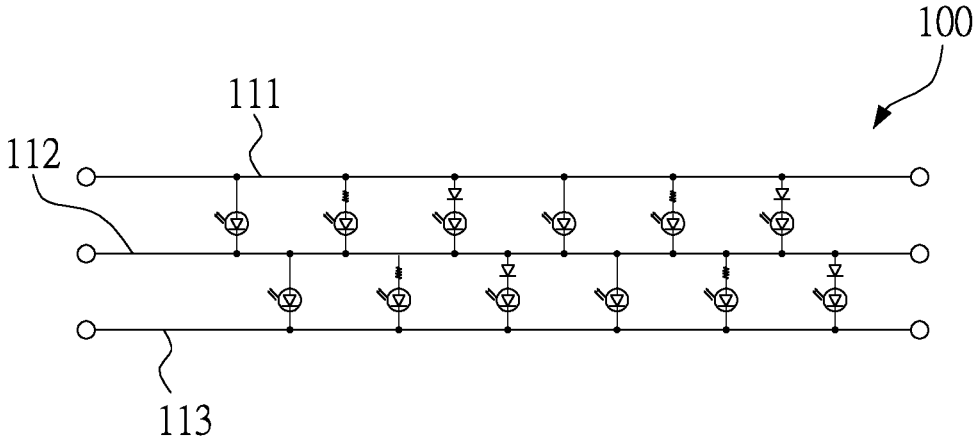
FIG. 6 is a circuit diagram of the parallel circuit for light emitting diodes according to a fifth embodiment of the present invention.

Referring to FIG. 6, a parallel circuit 100 for LEDs according to a fifth embodiment is shown, which is to arrange the parallel circuit 100 into a long light string. An embodiment of the present disclosure includes a parallel circuit 100 for LEDs, wires 111, 112 and 113 to form a light string. In an embodiment, the light string may comprise a power plug, AC to DC transformer, or a controller.

As shown in FIG. 6, the parallel circuit 100 in the fifth embodiment includes a first power wire 111, a second power wire 112, a third power wire 113, and a plurality of series circuits as described in the afore-mentioned embodiments. The series circuit can be a single LED (ex. the first LED 121) or one of the first, the second, and the third series circuits 101, 102, 103.

As shown in FIG. 6, in parallel circuit 100 of the fifth embodiment, the circuit arrangement between the first power wire 111 and the second power wire 112 can be selected from any arrangement with/without simple modification of the first to fourth embodiments. Actually, the second power wire 112 and the third power wire 113 are another pair of the first power wire 111 and second power wire 112, the circuit arrangement between the second power wire 112 and the third power wire 113 can be selected from any arrangement with/without simply modifying any of the first to fourth embodiments.

Figure 7:
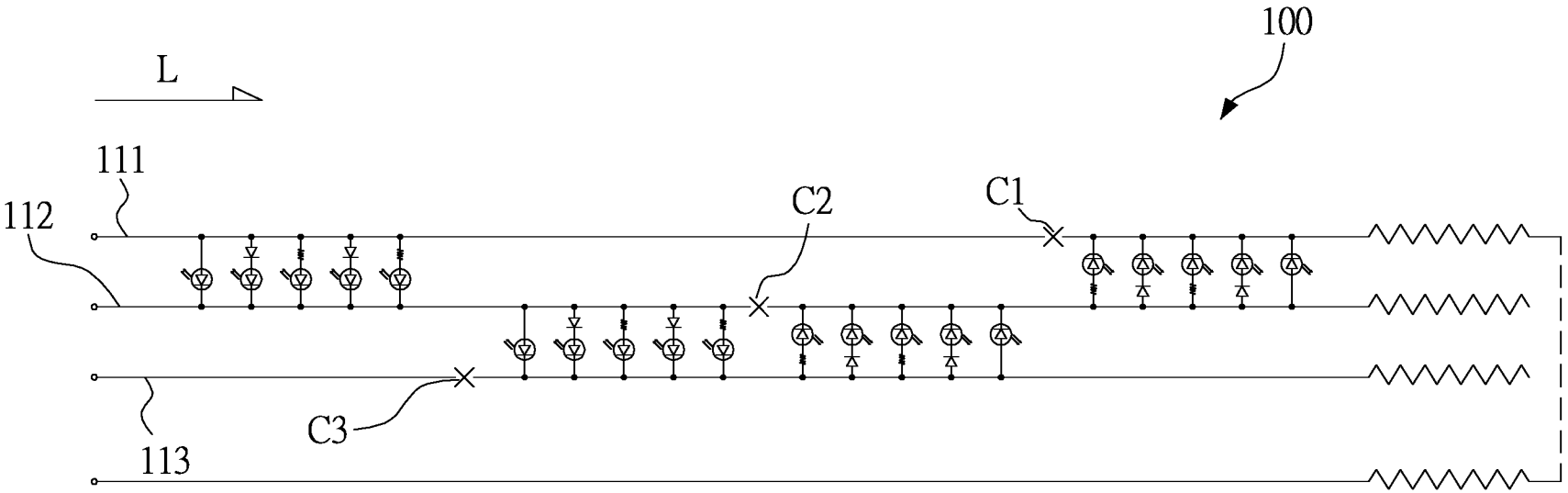
FIG. 7 is a circuit diagram of the parallel circuit for light emitting diodes according to a sixth embodiment of the present invention.

Referring to FIG. 7, a parallel circuit 100 for LEDs according to a sixth embodiment is shown, which is to arrange the parallel circuit 100 into a long light string.

Referring to FIG. 7, the parallel circuit 100 in the sixth embodiment includes a first power wire 111, a second power wire 112, a third power wire 113, and a plurality of series circuits as described in the afore-mentioned embodiments. The series circuit can be a single LED (e.g., the first LED 121) or one of the first, the second, and the third series circuits 101, 102, 103.

Referring to FIG. 7, in parallel circuit 100 of the sixth embodiment, a third cut-off point C3, a second cut-off point C2 and a first cut-off point C1 are provided to form required circuit loop. Each cut-off point represents an electrical discontinuity in the wire. The first power wire 111, the second power wire 112 and the third power wire 113 are arranged along an extension direction L. In one example, the three power wires 111, 112, 113 are single metal wires or are stranded conductors combined together by a one piece insulating layer. The third cut-off point C3, the second cut-off point C2, and the first cut-off point C1 are arranged sequentially along the light-string extension direction L, and cut or make discontinuous, the conductors of the third power wire 113, the second power wire 112, and the first power wire 111 in sequence, so as to divide the circuit 3 into a plurality of sections according to the third cut-off point C3, the second cut-off point C2 and the first cut-off point C1.

Referring to FIG. 7, in each section, a plurality of series circuits can be arranged, and these series circuits are connected in parallel in this section. The series circuit can be a single LED (e.g., the first LED 121) or one of the first, the second, and the third series circuits 101, 102, 103. Parallel circuits in different sections are substantially connected in series.

In a version of the sixth embodiment, the first power wire 111, the second power wire 112 and the third power wire 113 are arranged in parallel to form a single long light string for convenience of wiring arrangement.

Any of the embodiments of light strings above may be incorporated into an artificial tree, wreath, garland or other such decoration, such that embodiments of the present disclosure include an artificial tree, wreath or garland with a multi-color light string. Light strings of the present disclosure may be particularly suitable for an artificial tree that includes hundreds or thousands of LEDs. In such an embodiment, the artificial tree will have a relatively high concentration of LEDs 121 and 122 of different colors, such that variances in color and in brightness would be noticeable to a person viewing the tree. In an embodiment, such an artificial tree might comprise 500 to 1,500 LEDs for small to medium-sized trees of 5 ft. to 7 ft. in height, or even as many as 2,000 to 3,000 for larger trees of 7 to 12 ft. in height. The light string of the present disclosure eliminates such variances, providing an even appearance of color and brightness of the LEDs throughout the tree.

In other embodiments, a long light string of the present disclosure may be separated, such as by cutting, then configured into multiple rows of light strings which are interconnected, to form a net-like decorative lighting structure, typically referred to as a "net light". Because net lights present a fairly concentrated density of lighting, such as, e.g., 150 to 300 lights in a 4 ft×4 ft or 4 ft.×6 ft. rectangular area, a net light of the present disclosure that includes light strings having uniform color and brightness provides advantages over known LED-based light strings.

Similarly, a long light string of the present disclosure may be separated, such as by cutting, then configured into rows of varying lengths, commonly powered by a main power wire, to form an "icicle" style decorative lighting structure. Such an icicle-style decorative lighting structure provides the uniform color and brightness advantages as described above with respect to net lights.

In one or more embodiments of the present invention, LEDs with various turn-on voltages can be arranged in parallel, and each of the LEDs can emit light with predetermined brightness, so as to prevent the problem that the low turn-on voltage LED makes the other LEDs cannot be turned-on or be turned-on with lower brightness.

What is claimed is:

1. A parallel circuit for light emitting diodes comprising:

a first power wire and a second power wire;

a first light emitting diode with a first turn-on voltage, a first end of the first light-emitting diode directly connected to the first power wire, and a second end of the first light-emitting diode directly connected to the second power wire;

a second series circuit comprising:

a single second light emitting diode with a second turn-on voltage, wherein the first turn-on voltage is different from the second turn-on voltage; and a second impedance element, connected to the second light emitting diode to form the second series circuit; wherein one end of the second series circuit is electrically connected to the first power wire, while the other end of the second series circuit is electrically connected to the second power wire, wherein the first light emitting diode is electrically connected to the second series circuit in parallel.

2. The parallel circuit as claimed in claim 1, wherein the second turn-on voltage is smaller than the first turn-on voltage.

3. The parallel circuit as claimed in claim 1, wherein the first power wire and the second power wire provide a driving voltage difference and the driving voltage difference is larger than the first turn-on voltage.

4. The parallel circuit as claimed in claim 3, wherein the second impedance element determines a voltage difference between the first and second ends of the second light emitting diode, such that the voltage difference between the first and second ends of the second light emitting diode is smaller than the driving voltage difference and larger than the second turn-on voltage.

5. The parallel circuit as claimed in claim 1, wherein the second impedance element is a resistor or a diode.

6. A light string, comprising:

a first power wire and a second power wire;

a plurality of first light emitting diodes, each of the plurality of first light emitting diodes having a first turn-on voltage, an anode of each of the first light-emitting diodes directly connected to the first power wire, and a cathode of each of the first light-emitting diodes directly connected to the second power wire;

a plurality of second light emitting diodes, each of the plurality of second light emitting diodes having a second turn-on voltage, wherein the first turn-on voltage is less than the second turn-on voltage; and a plurality of impedance elements, each of the plurality of impedance elements connected in series to one of the plurality of second light emitting diodes to form a plurality of series circuits, each of the plurality of series circuits comprising one of the plurality of second light emitting diodes and one of the plurality of impedance elements connected in series; wherein one end of each of the plurality of series circuits is electrically connected to the first power wire, and another end of each of the plurality of series circuits is electrically connected to the second power wire, such that each of the plurality of series circuits is connected to the other in parallel, wherein each light emitting diode of the plurality of first light emitting diodes is electrically connected in parallel with at least one series circuit of the plurality of series circuits.

7. The light string of claim 6, wherein each of the plurality of first light emitting diodes is surrounded by transparent material to form a first plurality of light-string lamps, and each of the series circuits is surrounded by transparent material to form a second plurality of light-string lamps.

8. The light string of claim 7, wherein each lamp of the first plurality of light-string lamps emits light of a first color, and each lamp of the second plurality of light-string lamps emits light of a second color, the first color being different from the second color.

9. The light string of claim 6, wherein each of the plurality of first light emitting diodes is configured to emit light of a first color, and each of the plurality of second light emitting diodes is configured to emit light of a second color, the first color being different from the second color.

10. The light string of claim 6, wherein each of the plurality of impedance elements comprises a resistor.

11. The light string of claim 6, wherein each of the plurality of impedance elements comprises a diode.

12. The light string of claim 6, further comprising a third power wire, the third power wire extending in a direction parallel to the first power wire and the second power wire.

13. The light string of claim 12, further comprising a third plurality of light emitting diodes, each of the third plurality of light emitting diodes directly connected at an anode end to the second power wire and directly connected at a cathode end to the third power wire.

14. The light string of claim 13, further comprising a fourth plurality of light emitting diodes and another plurality of impedance elements, each of the fourth plurality of light emitting diodes connected to one of the other plurality of impedance elements to form a plurality of second series circuits, each of the plurality of second series circuits connected at one end to the second power wire and at another end to the third power wire.

15. The light string of claim 12, wherein at least one of the first, second or third power wire includes a point of discontinuity wherein a conductor of the at least one of the first, second or third power wire is not continuous.

16. The light string of claim 6, wherein the first power wire and the second power wire provide a driving voltage difference and the driving voltage difference is larger than the first turn-on voltage.

17. The light string of claim 16, wherein each of the second impedance elements determines the voltage difference between the first and second ends of the second light emitting diode, such that the voltage difference between the first and second ends of the second light emitting diode is smaller than the driving voltage difference and larger than the second turn-on voltage.

18. An artificial tree having a plurality of light strings according to claim 6.

* * * * *